US005332293A

United States Patent [19]

Higgins et al.

[11] Patent Number: 5,332,293

[45] Date of Patent: Jul. 26, 1994

[54] APPARATUS FOR CUTTING EROSIVE MATERIALS USING HIGH PRESSURE WATER DEVICE

[75] Inventors: Christopher L. Higgins; Stanley R. Burgess, both of Arcadia, Australia

[73] Assignee: Australian Stone Technology Pty. Ltd., Vaucluse, Australia

[21] Appl. No.: 807,878

[22] PCT Filed: Jun. 26, 1990

[86] PCT No.: PCT/AU90/00270

§ 371 Date: Mar. 23, 1992

§ 102(e) Date: Mar. 23, 1992

[87] PCT Pub. No.: WO91/01432

PCT Pub. Date: Feb. 7, 1991

[30] Foreign Application Priority Data

Jul. 21, 1989 [AU] Australia ..... PJ 5387

[51] Int. Cl.[5] ..... E21C 25/60; E21C 47/10

[52] U.S. Cl. ..... 299/15; 239/101; 299/17

[58] Field of Search ..... 299/15, 17; 239/101; 175/67, 424

[56] References Cited

U.S. PATENT DOCUMENTS

| | | | |
|---|---|---|---|
| 2,018,926 | 10/1935 | Schroepfer | 299/17 |
| 3,326,607 | 6/1967 | Book | 299/17 X |
| 3,796,371 | 3/1974 | Taylor et al. | 239/101 |
| 3,844,362 | 10/1974 | Elbert et al. | 175/94 |
| 3,857,516 | 12/1974 | Taylor et al. | 239/186 |
| 3,960,407 | 6/1976 | Noren | 299/17 |
| 4,106,577 | 8/1978 | Summers | 175/340 |
| 4,111,490 | 9/1978 | Lieseveld | 299/17 |
| 4,119,160 | 10/1978 | Summers et al. | 175/67 |
| 4,176,883 | 12/1979 | Liesveld | 299/15 X |
| 4,240,664 | 12/1980 | Mahyera | 299/17 |
| 4,314,730 | 2/1982 | Plumpton et al. | 299/75 |
| 4,367,902 | 1/1983 | Schwarting et al. | 299/42 |
| 4,529,046 | 7/1985 | Schmidt et al. | 175/107 |
| 4,625,815 | 12/1986 | Spies | 175/73 |
| 4,854,770 | 8/1989 | Puchala et al. | 299/17 X |

FOREIGN PATENT DOCUMENTS

| | | |
|---|---|---|
| 21994/83 | 12/1983 | Australia . |
| 39702/85 | 3/1985 | Australia . |
| 66411-86 | 12/1985 | Australia . |
| 71765/87 | 4/1987 | Australia . |
| 35007/89 | 5/1989 | Australia . |
| 189024 | 12/1985 | European Pat. Off. . |
| 2929153 | 7/1979 | Fed. Rep. of Germany . |
| 3523795 | 7/1985 | Fed. Rep. of Germany . |
| 483526 | 3/1972 | U.S.S.R. . |
| 883451 | 2/1980 | U.S.S.R. . |
| 1460711 | 1/1977 | United Kingdom . |
| 89/01396 | 2/1989 | World Int. Prop. O. . |

OTHER PUBLICATIONS

Derwent Abstract Accession No. N1429E/40, SU, A, 883451 (As Kaza Mining Inst) Nov. 28, 1981.

Derwent Abstract Accession No. 89-355333/48, SU, A, 1483043 (UKR Undergrd Hydrau) May 30, 1989.

*Primary Examiner*—David J. Bagnell

*Attorney, Agent, or Firm*—Banner, Birch, McKie & Beckett

[57] ABSTRACT

Apparatus for cutting erosive materials such as stone and the like includes a high-velocity, high-pressure water lance which can be raised and lowered as necessary. The lower end of the water lance carries a cutting head in the form of a nozzle assembly able to be rotated about the longitudinal axis of the water lance. The water lance is mounted upon a carriage which can be propelled in directions at right angles to each other and the water lance may be supported by a vertically-disposed truss, which itself may be relocatable about the longitudinal axis of the lance.

13 Claims, 8 Drawing Sheets

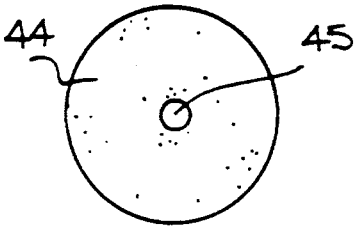
FIG. 9
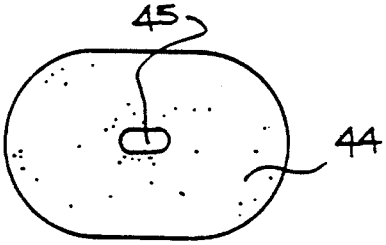
FIG. 10
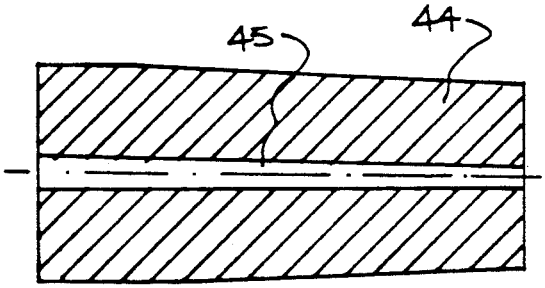
FIG. 11
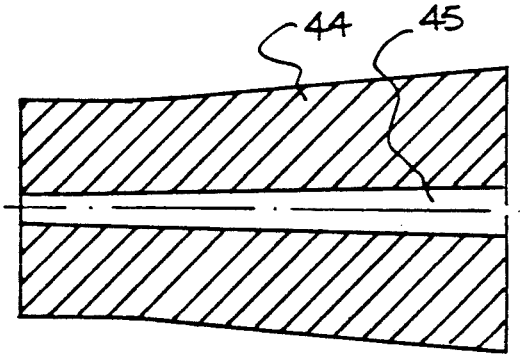
FIG. 12
FIG. 13
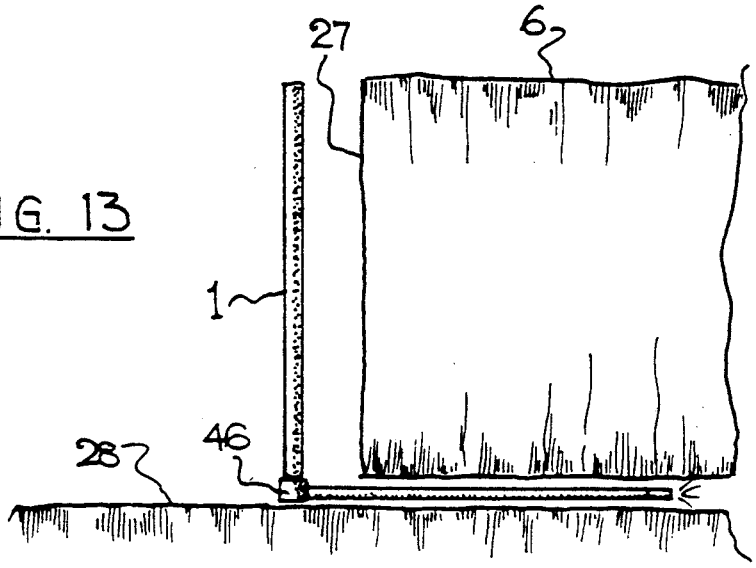

APPARATUS FOR CUTTING EROSIVE MATERIALS USING HIGH PRESSURE WATER DEVICE

TECHNICAL FIELD

This invention relates to apparatus for cutting erosive materials such as stone and the like by high-pressure water means and to quarrying or rock excavation, and more particularly to a method and apparatus for the winning of complete blocks from a quarry by the use of a new, or at least much-improved, high-pressure water lance cutting head.

BACKGROUND ART

It has been recognized that a jet of liquid emitted though a nozzle, particularly a nozzle having a small orifice, will cut or, more properly erode, hard substances such as stone if the velocity is high enough.

A typical example of prior art is to be found in U.S. Pat. No. 4,111,490, to D. J. LIESVELD, which discloses, inter alia, apparatus for the channel cutting of hard materials using high-velocity fluid jets. U.S. Pat. No 4,111,490 teaches the use of a water lance having a nozzle which, "preferably is held fixed for each channel cut pass but can be oscillated in a direction normal to the material surface while being moved along a line spaced from but parallel to the surface of material to be cut." The entire apparatus moves along rails which are laid on the surface of the work surface and, after a channel cut has been completed, the nozzle assembly is lowered and a deeper channel cut line is eroded until the required or desired cutting depth has been attained. The lance itself is unsupported, however and thus may well be "whippy" although the specification is silent on this point. With such a whippy, unsupported lance the depth of cut possible is limited since the lance becomes unstable. Moreover, more oscillation of the cutting head cannot provide optimal conditions for the winning of blocks of stone from, say, a natural outcrop of the material to be won.

Other, and perhaps less relevant, examples of prior art apparatus are to be found in:

1) Australian Patent No. 543913, by DRAVO CORPORATION;
2) Australian Patent No. 567396, by CHARLES LOEGEL JNR;
3) Australian Patent Application No 66411/86 by TADOLE PTY LTD;
4) U.K. Patent No. 1460711, by PRESSURE DYNAMICS LTD;
5) U.S. Pat. No. 3,857,516, by N. S. H. TAYLOR et al;
6) U.S. Pat. No. 3,960,407, by C. A. NOREN;
7) U.S. Pat. No. 3,796,371, by N. S. H. TAYLOR et al;
8) U.S. Pat. No. 4,240,664, by A. MAHYERA; and
9) U.S. Pat. No. 4,367,902, by K. H. SCHWARTING et al.

DISCLOSURE OF THE INVENTION

It is therefore an object of the present invention to overcome the above and other disadvantages of the prior art by the provision of, in a first aspect thereof, apparatus for cutting erosive materials, comprising a rigid, high-velocity, high-pressure water lance; a cutting head mounted at the lower end of the said water lance; means for advancing or lowering said water lance and associated cutting head towards the surface of the material to be cut; means for moving the said water lance and associated cutting head along the surface to be cut; and means for rotating the water lance and cutting head mounted thereon about the longitudinal axis of the said water lance.

Pressurized water may be supplied to the water lance through a hydraulic pipeline via a rotatable coupling or union which ideally includes a water inlet port, a plenum chamber, and a tubular spigot or nipple which is connectable to, and rotatable with, the water lance.

The water lance may be further supported by a truss, which truss is ideally able to be swung into any one of three positions relative to the water lance.

The cutting head may be provided with one or more outlet orifices adapted to emit high-pressure, high velocity water jets angled at predetermined angles to the vertical (e.g. about 20° to about 90°); alternatively, the cutting head may have a single outlet orifice disposed normal to the longitudinal axis of the water lance. In a further embodiment, the cutting head or part thereof may be constituted by a length of hardened steel rod having a concentric bore therethrough which is progressively flared at the outlet end, for example by progressively compressing the rod at one end so as to flatten the bore to thereby enable a fan-shaped, high-pressure, high-velocity water jet to be emitted therefrom.

In a second aspect, the present invention may consist in a method for the winning of blocks of stone or the like material from an outcrop thereof, comprising making horizontal and vertical cuts therein by the use of a rigid, high-velocity, high-pressue water lance, this water lance having a cutting head, as above described, mounted at the lower end thereof, and there being means provided for advancing or lowering the water lance and its cutting head towards the surface of the material to be cut; means provided for moving said water lance and associated cutting head along the surface to be cut; means also being provided for rotating the water lance and cutting head about the longitudinal axis of the water lance.

DESCRIPTION OF THE DRAWINGS

In order that a better understanding of the present invention may be gained, hereinafter will be described certain embodiments thereof, by way of example only and with reference to the accompanying drawings in which,:

FIG. 9 to 12 show the construction of a fan-jet cutting head;

FIG. 13 is a schematic drawing similar to that of FIG. 6;

MEANS FOR CARRYING OUT THE INVENTION

Figure 1:
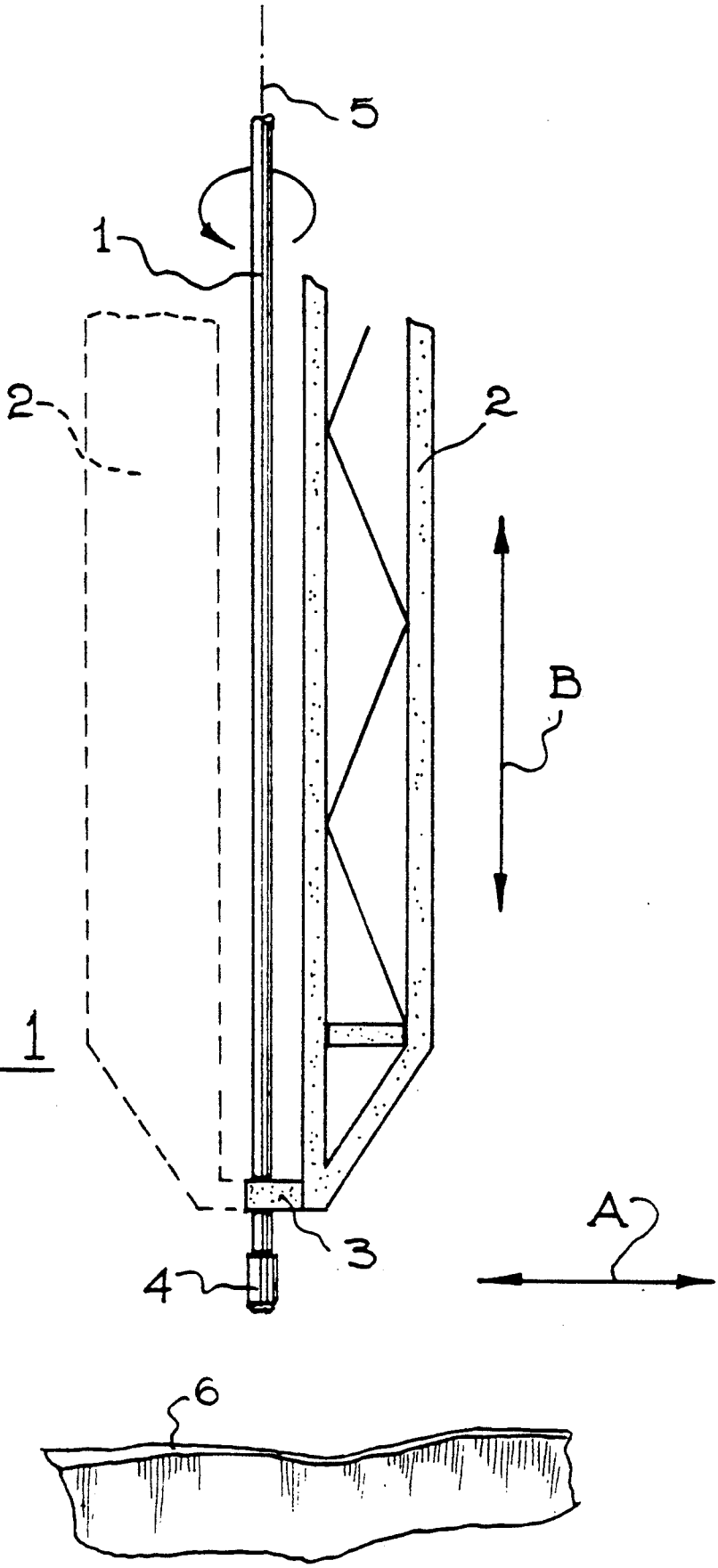
FIG. 1 shows a lower section of an inventive water lance fitted with a supporting truss.

In FIG. 1 there is to be seen the lower end of a rigid high-pressure, high-velocity water lance 1 which, in this embodiment, is further supported by a truss 2 at, at least, at location 3. A nozzle assembly 4 located at the lower extremity of water lance 1 is adapted to emit one or more high-pressure, high-velocity jets of water angled downwardly at perhaps 20° to the vertical. The nozzle assembly or cutting head 4 will later be more fully described with reference to FIG. 3. While these jets are operating, water lance 1 rotates about its longitudinal axis 5 to thereby cut, or erode, a groove wider than the lance or truss assembly in the surface 6 of the rock outcrop to be cut, in the direction of travel indicated by the arrow A.

Figure 2:
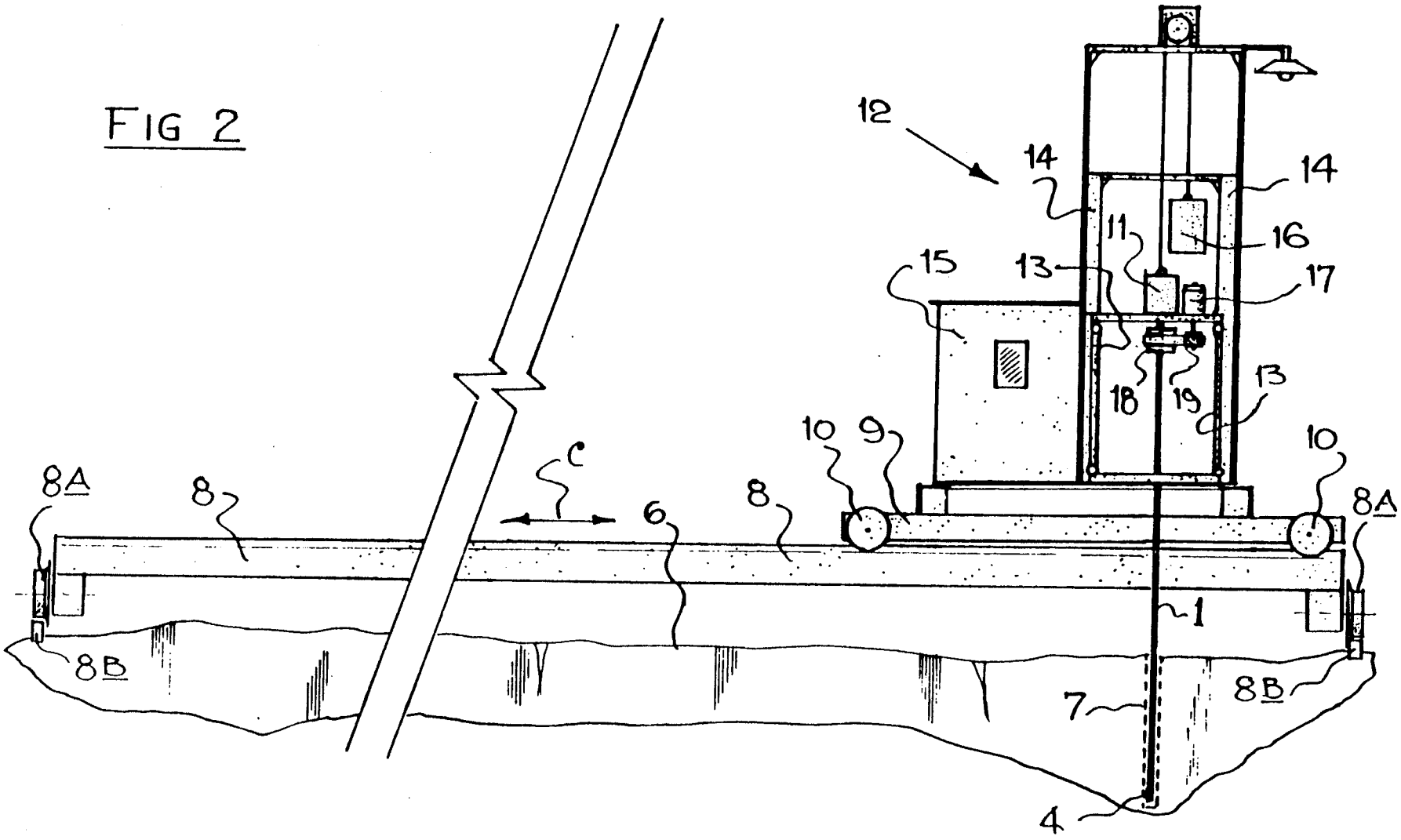
FIG. 2 is a side elevation of the entire apparatus in situ on an outcrop of stone.

Turning now to FIG. 2, in side-on view the width of the lance and an associated truss, if such is employed, will be seen to be less than the width of the groove 7 in rock surface 6 and thus may be progressively lowered (see arrow B of FIG. 1) into the cut or groove 7 up to the required or desired depth, usually up to, say, six meters.

Referring back to FIG. 1, while the presence of a water lance, supporting truss does indeed reinforce the rigidity inherent in the water lance, when such a truss is employed, it is highly advantageous for the truss 2 to be able to be swung about the water lance into any one of three positions relative thereto. In FIG. 1, the broken line to the left-hand side of water lance 1 indicates a position at 180° to that indicated by "truss 2" at the right-hand side of the water lance 1; needless to say, a third angular position of truss 2 is that intermediate the two shown: at an angle of 90° to either of the previously described positions. The truss 2 is thus able to be swung about the water lance in accordance with which end of the cut is the "blind end".

The truss 2 may be removed from water lance 1 for detailed cutting operations; for example, for the winning of shaped blocks for further processing, for the cutting of rectangular or circular sectioned columns, and the shaping of steps. A particular application of such detailed cutting will be hereinafter described with reference to FIGS. 16 and 17 of the drawings.

FIG. 2 is a side elevation of the inventive apparatus, seen in situ on an outcropping of stone from which blocks are to be won.

A pair of spaced-apart, parallel beams, or girders, 8, constitute rails upon which a travelling carriage 9, mounted on wheels 10, is able to move in the direction indicated by arrow C. Furthermore, the parallel beams or girders 8 themselves constitute a movable carriage able to move the entire apparatus in a direction which is also normal to direction C, on wheels 8A mounted on rails 8B.

The travelling carriage 9 supports a super-structure, generally referenced 12, which includes a vertically-slidable, lance-carrying frame 13 able to move up and down a co-operating trackway 14 so that the water lance and its cutting head 4 is enabled to be lowered towards stone outcrop surface 6 and to be raised therefrom. Travelling carriage 9 also supports a control cabin 15.

The vertically-slidable, lance-carrying frame 13 is raised and lowered by means of a hydraulic winch (not shown), and counterbalanced by a pendant weight 16 and incorporates a hydraulic motor 17 which rotatably drives a pulley 18, via a belt or chain 19: thuswise, water lance 1 may be rotated about its longitudinal axis 5.

A compressor, or compressors, may well be remotely located to supply pressurized water to the water lance 1 through the requisite hydraulic pipeline via a rotatable coupling or union 11.

Rotatable coupling or union 11 may well take the form of a vessel, preferably cylindrical, defining a plenum, chamber therewithin and which is rigidly attached, as by bolts, to the vertically-slidable, lance-carrying frame 13. The base of rotatable coupling or union 11 is provided with a tubular spigot, or nipple, which is free to rotate in a gland or like liquid-tight bearing means, this spigot being connectable to, and rotatable with, the water lance 1. Adjacent the top wall of the rotatable coupling 11 is a water inlet port connectable to the said requisite hydraulic pipeline.

Figure 3:
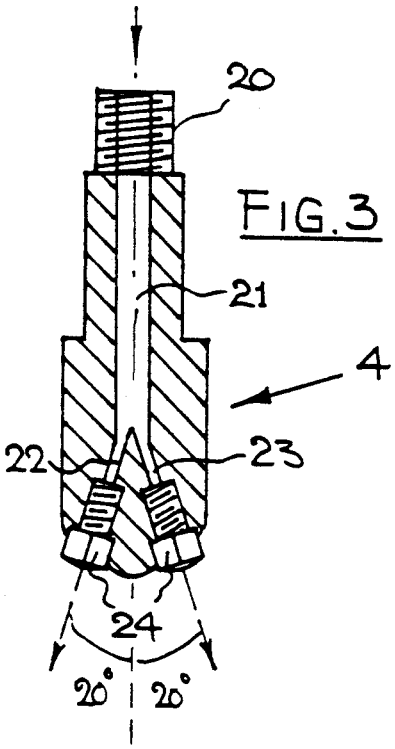
FIG. 3 is a cross-section through a cutting head having angled twin jets.

FIG. 3 is a vertical cross-section through a nozzle assembly or cutting head 4; the cutting head is ideally turned from hardenable steel rod stock and has an externally-threaded portion 20 adapted to screw into a co-acting internal thread cut at the lower end of the water lance 1. Water conduit 21 of cutting head 4 diverges into two nozzle outlets 22, 23 each of which terminates in a screwed-in nozzle 24 the orifices of which are adapted to emit high-pressure, high-velocity water jets angled downwardly at, say, 20° to the vertical. In another embodiment, shown in FIG. 4, the water conduit 21 is angled as illustrated and terminates in a horizontal screwed-in nozzle 25 for the purpose of making "undercuts". A cutting head such as that shown in FIG. 4 may be fitted with a horizontally, extending conduit 26, as is to be seen in FIG. 5, which may incorporate a fan jet nozzle at the cutting end enabling a cut to be made exceeding the width of the nozzle and conduit.

Figure 6:
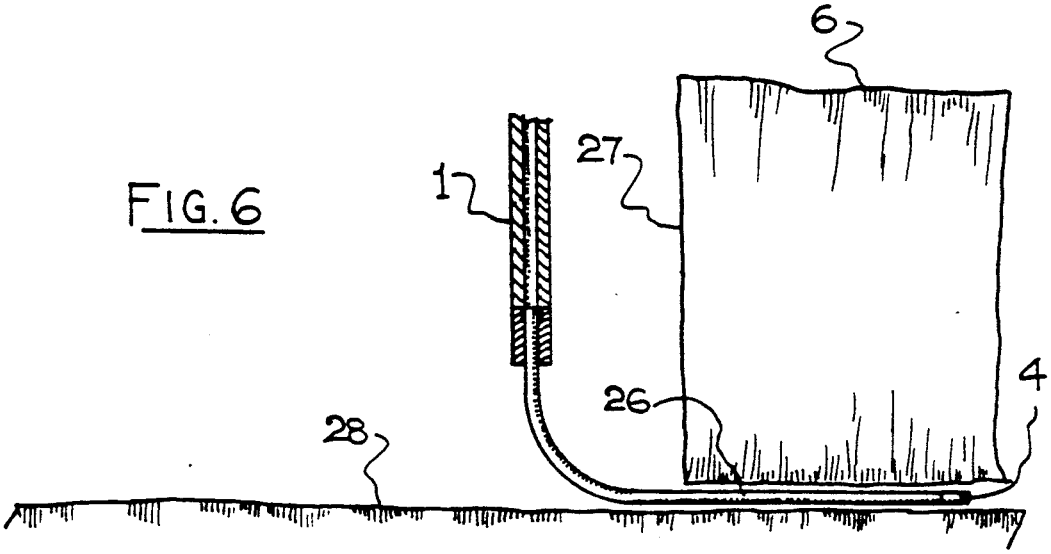
FIG. 6 schematically shows how an undercut may be made, the bottom of the cut being flush with the working floor level.

FIG. 6 graphically illustrates how an undercut is able to be made, the bottom of the (lowest) cut made in the face 27 of a rock outcrop being flush with the "working floor" level 28, to ensure ease and efficiency of working the outcrop without having to contend with different working floor levels. Again, the cutting end of the cutting head 4 may incorporate a fan jet nozzle as described above.

Figure 4:
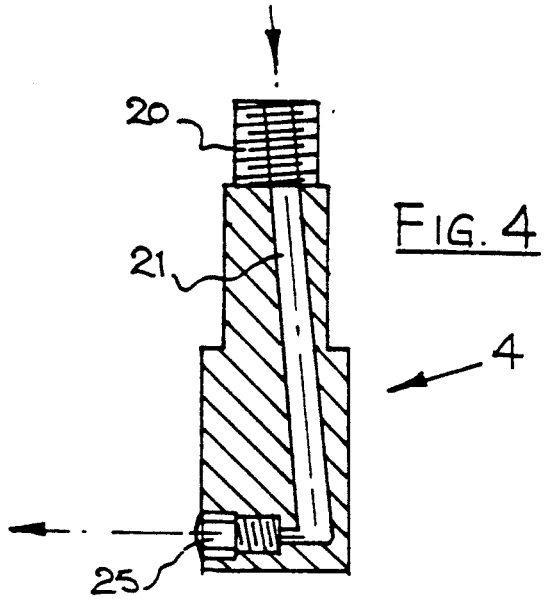
FIG. 4 is a cross-section through a second embodiment of a cutting head having a horizontal jet.
Figure 7:
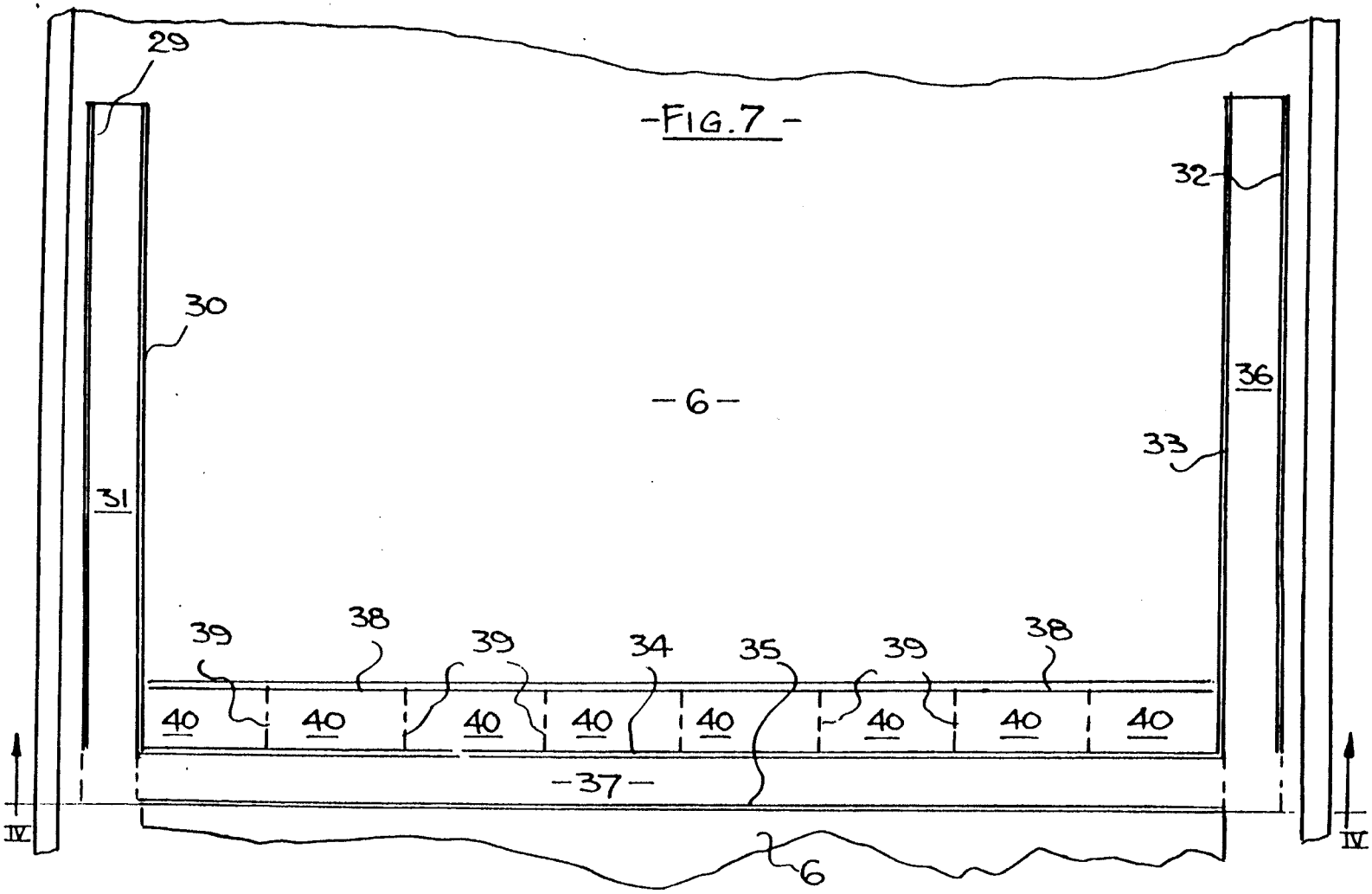
FIG. 7 is a plan view of a stone outcrop showing initial cuts made by the cutting head of the inventive apparatus.

FIG. 7 is a plan view of a stone outcrop showing initial cuts to be made in order to quarry complete, that is to say, whole or entire, blocks of stone. Initially, water lance 1 is moved to and fro on rails 8 to cut primary grooves or cuts 29 and 30 to the required, or desired, depths. The angle-jet nozzle 4 on the lower end of water lance 1 is then replaced by a nozzle having one or more horizontal jets, such as shown in FIG. 4, and suitable horizontal and vertical cuts made so that the so-won blocks may be removed to thereby form a trench 31. In similar fashion, primary cuts 32, 33 and 34, 35 are made together with such vertical and horizontal cuts as are necessary, and blocks removed to form trenches 36 and 37 respectively. Trenches 31, 36 and 37 are then able to function as drainage channels for removal of eroded material and water. If required the water may be recycled through water lance 1 for further usage. Co-acting primary cuts, as 38 and 39, may then be made to thus enable blocks 40 to be cut.

Figure 8:
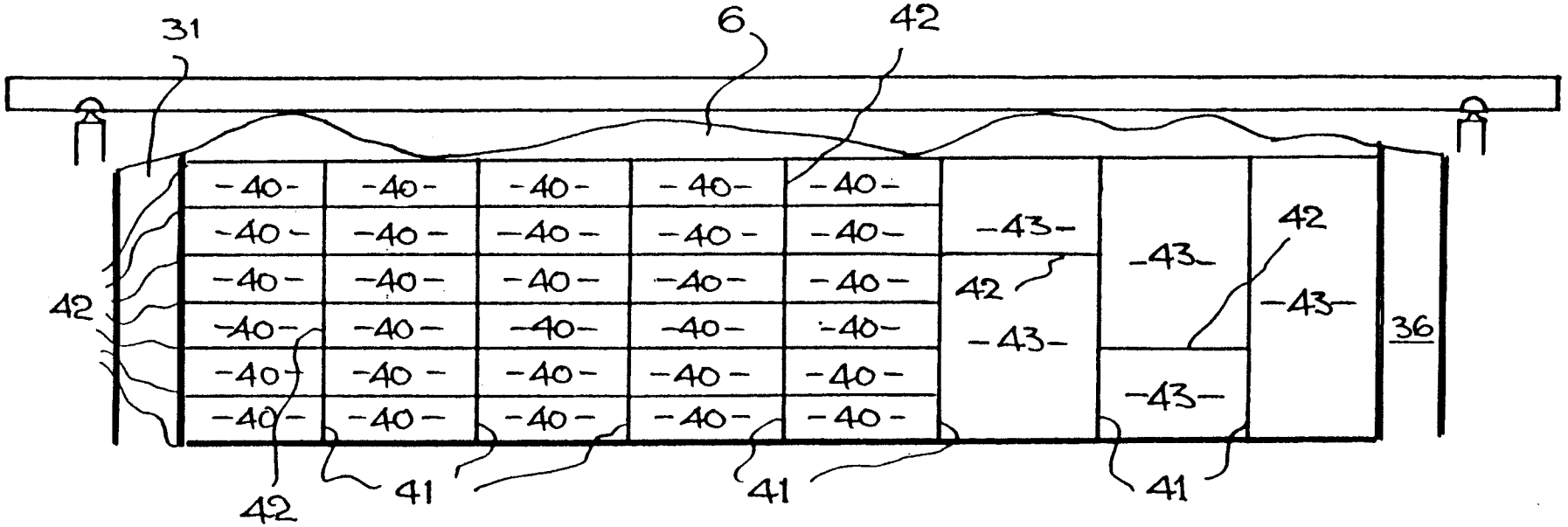
FIG. 8 is a corresponding elevational view.

FIG. 8 shows, in elevational view, how blocks may be progressively won to the full depth of the cut. These blocks are to be had by making vertical cuts 41 and co-operating horizontal cuts 42; however, larger blocks, as those referenced 43, may well be removed for subsequent processing and/or sizing.

While FIGS. 3 and 4 show cutting heads 4 having screwed-in nozzles 24 and 25, FIGS. 9 to 12 illustrate how a fan-jet cutting head is advantageously fabricated. The fan-jet is made from a short length of hard steel rod 44 through which is drilled a bore 45 of the requisite diameter; then, as will be clear from FIGS. 10, 11 and 12, the drilled length of rod 44 is compressed, as shown in FIG. 10, progressively to give the necessary degree of "flare"; FIGS. 11 and 12 are cross-sections, normal with respect to each other, of the fan-jet cutting head. This construction of nozzle assembly, or cutting head results in a water jet which is emitted in a fan-shaped form, as distinct from the linear water jets emitted from nozzles 24 and 25 of FIGS. 3 and 4. Such a fan jet will erode a cut or groove which is wider than the water lance itself.

Figure 5:
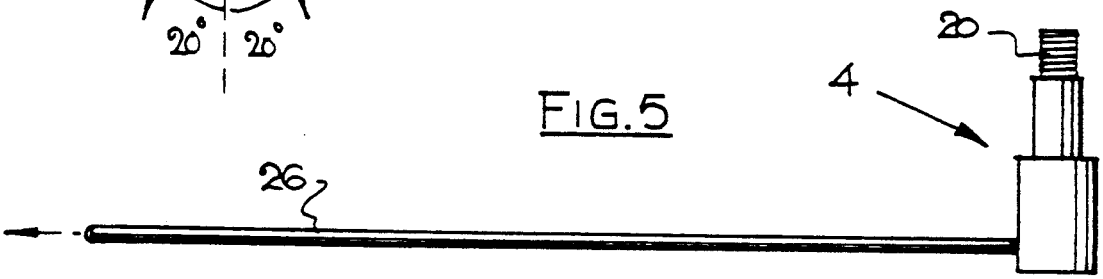
FIG. 5 shows the cutting head of FIG. 4 but fitted with a horizontal extension.

FIG. 13 represents a variation on the arrangement shown in FIGS. 5 and 6, the water lance 1 being fitted with a rotary union 46, similar to rotary union 11 described above, together with associated motor and driving mechanism, which enables the extension 26 to be rotated to provide for horizontal undercutting to be carried out; this embodiment is an alternative to that of FIG. 6 and is to be preferred under certain circumstances.

Figure 14:
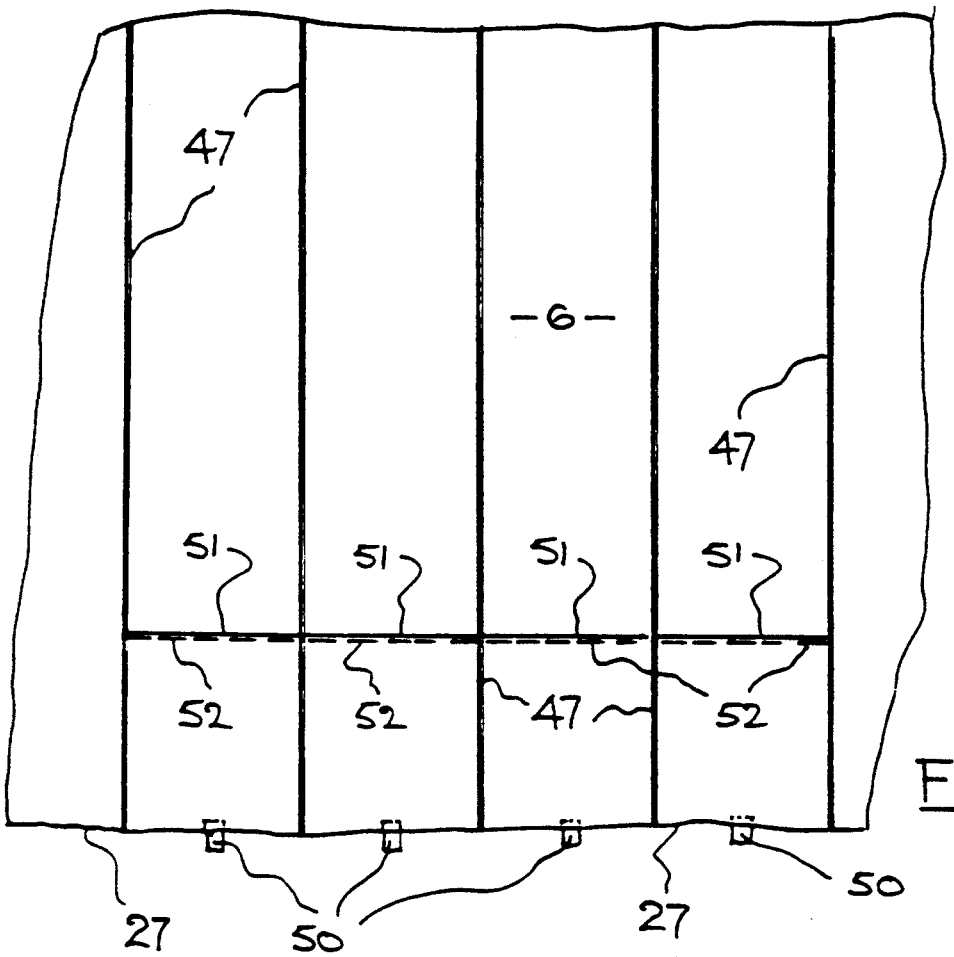
FIG. 14 is a plan view of a stone outcrop illustrating a cutting sequence.
Figure 15:
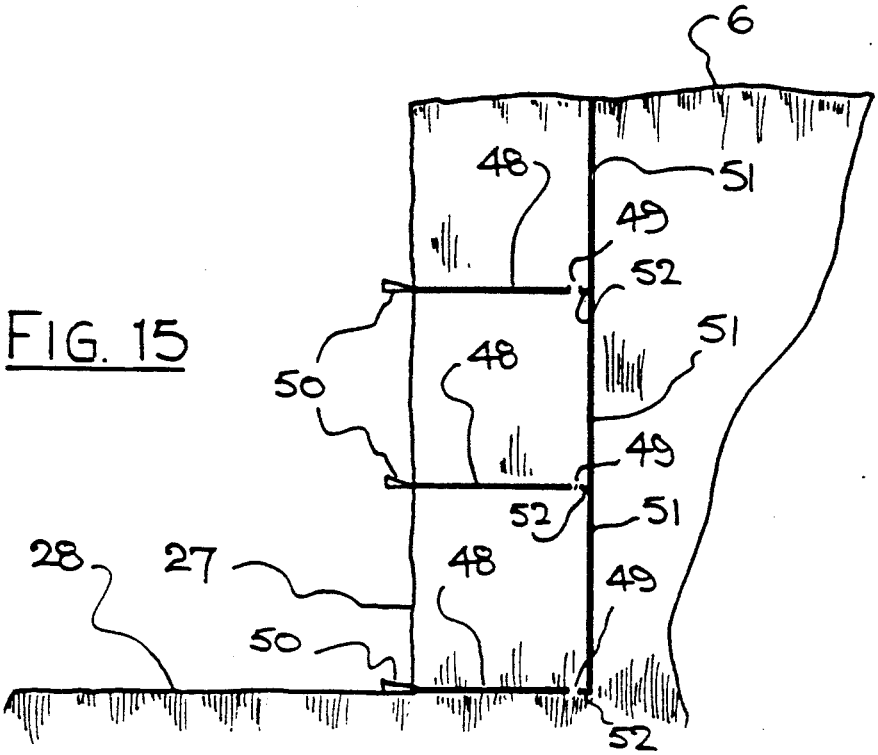
FIG. 15 is a corresponding elevational view.

FIG. 14, which is a plan view, and FIG. 15 which is a sectional view, graphically illustrate a typical cutting sequence which may be employed for winning blocks from a stone outcrop. Firstly, longitudinal trenches 47 are cut to the requisite length and depth, preferably using a rotating cutting head having angled twin jets, as shown in FIG. 3. Next, undercuts 48 are made, preferably using a rotating fan jet cutting head as shown in FIGS. 9 to 12, but leaving small supporting ribs 49 at the rear of the cuts; on completion of cuts 48, wedges 50 are put in place to support the blocks. A transverse rear trench 51 is then cut, preferably by an angled twin jet cutting head. Finally, using a non-rotating horizontal single jet cutting head, as that of FIG. 4, small cuts 52 are made for the purpose of preventing the corners from breaking when the blocks are lifted out.

Figure 16:
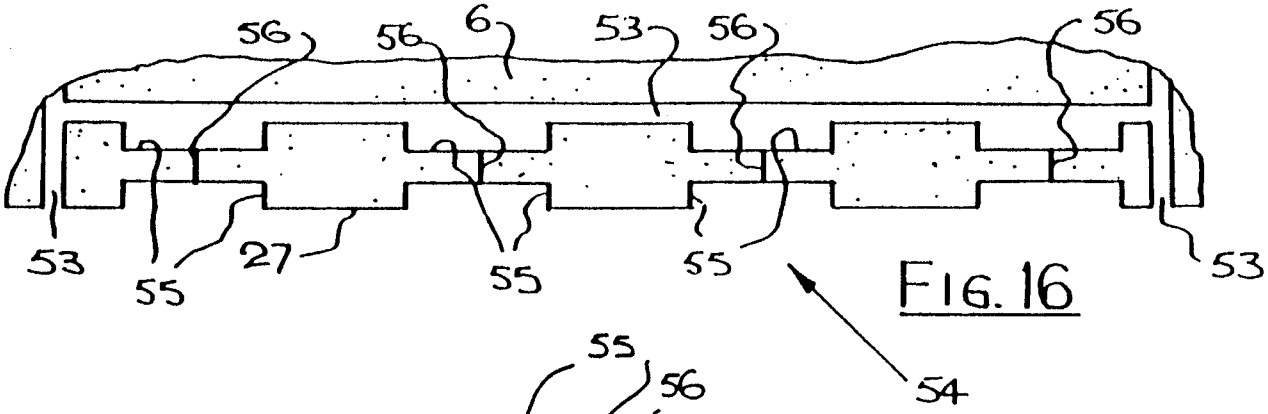
FIGS. 16 and 17 show the cutting of stone to a shape suitable for further processing into quoins for building construction. Throughout the drawings, like integers are referenced by the same numeral.
Figure 17:
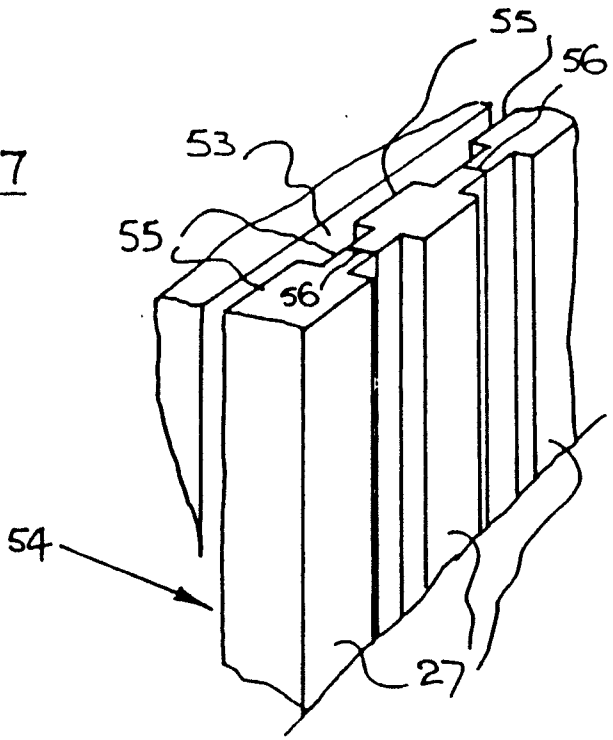

FIG. 16 and 17 show an example of detailed cutting using the high-pressure, high-velocity water lance without the supporting truss; these Figures show the cutting of quoins suitable for building construction.

The usual trenches, referenced 53, are cut so as to provide a block generally referenced 54. Firstly the shaped cuts 55 are made without the supporting truss 2, using an angled twin jet cutting head, see FIG. 3, and then the quoin blanks are separated by the vertical cuts 56 made with a horizontal jet cutting head. The quoin blanks may then be further processed as required.

From the above-going, it will be appreciated by those skilled in the art that many more variations or modifications may be made to the invention without departing from the scope and spirit thereof as set out in the ensuing claims.

We claim:

1. Apparatus for accurate cutting of erosive materials, using hydraulic means along, comprising a rigid high velocity, high pressure water lance, said water lance including a water directing cutting head at the lower end thereof, means for selectively translocating said lance and head about 3 independent axes with respect to a surface of the material to be cut, and wherein said water lance is further supported by a truss which is able to be swung into at least three different positions relative to said water lance.

2. Apparatus as claimed in claim 1, wherein said cutting head is provided with two or more outlet orifices adapted to emit high-pressure, high velocity water jets angles at predetermined angles to the vertical.

3. Apparatus as claimed in claim 1 wherein said cutting head has a horizontal conduit extending therefrom for the making of undercuts.

4. Apparatus for accurate cutting of erosive materials, using hydraulic means alone, comprising only one rigid high velocity, high pressure water lance, said water lance including a water directing cutting head at the lower end thereof, means for selectively translocating said lance and head about 3 independent axes with respect to a surface of the material to be cut, and wherein said cutting head has a horizontal conduit extending therefrom for the making of undercuts.

5. Apparatus according to claim 1 or claim 4, further comprising means for rotating said cutting head about the longitudinal axis of the lance.

6. Apparatus as claimed in claim 1 or claim 4, wherein pressurized water is supplied to said water lance through a hydraulic pipeline via a rotatable coupling or union.

7. Apparatus as claimed in claim 6, wherein said rotatable coupling or union includes a water inlet port, a plenum chamber, and a tubular spigot or nipple which is connectable to, and rotatable with, the said water lance.

8. Apparatus as claimed in claim 1 or claim 4, wherein said cutting head is provided with an outlet orifice oriented substantially normal to the longitudinal axis of the said water lance.

9. Apparatus as claimed in claim 1 or claim 4, wherein said cutting head or a part thereof is constituted by a length of hard steel rod having a concentric bore therethrough, which is progressively flared at the outlet end to thereby enable a fan-shaped high-velocity, high-pressure water jet to be emitted therefrom.

10. Apparatus adapted for accurate cutting of erosive materials, using hydraulic means alone, comprising only one rigid high velocity water lance, said water lance including a water directing cutting head at the lower end thereof, and means for selectively translocating said water lance and cutting head about 3 independent axes with respect to a surface to be cut, so as to allow said cutting head to operatively cut in 3 substantially perpendicular planes within a body of material and hence permitting the removal of said erosive material in block form.

11. Apparatus as claimed in claim 10, wherein each of said cuts are performed using one of a set of cutting heads, at least one of said cutting heads including a substantially horizontal conduit for performing an undercut.

12. Apparatus as claimed in claim 10 or 11, wherein said cutting head or a part thereof is constituted by a length of hard steel rod having a concentric bore therethrough, which is progressively flared at the outlet end to thereby enable a fan-shaped high-velocity, high-pressure water jet to be emitted therefrom.

13. Apparatus as claimed in claim 10, wherein said water lance is supported by a truss, said truss being able to be placed in a plurality of positions with respect to said water lance.

* * * * *